United States Patent [19]

Marzullo

[11] Patent Number: 4,799,989

[45] Date of Patent: Jan. 24, 1989

[54] DOCUMENT MOISTENING DEVICE

[75] Inventor: Joseph H. Marzullo, Danbury, Conn.

[73] Assignee: Pitney Bowes Inc., Stamford, Conn.

[21] Appl. No.: 115,219

[22] Filed: Oct. 30, 1987

[51] Int. Cl.[4] ..... B31F 1/00

[52] U.S. Cl. ..... 156/442.1; 156/443; 156/227; 156/578; 493/420; 493/421; 270/45; 118/253

[58] Field of Search ..... 118/253, 264, 266, 267; 493/420, 421; 156/442.1, 443, 227, 578; 270/45, 39, 40

[56] References Cited

U.S. PATENT DOCUMENTS

| | | | |
|---|---|---|---|
| 3,995,808 | 12/1976 | Kehoe . | |
| 4,530,730 | 7/1985 | Bradley et al. | 156/227 |
| 4,530,731 | 7/1985 | Bradley | 156/227 |
| 4,531,993 | 7/1985 | Bradley | 156/227 |
| 4,668,212 | 5/1987 | Kotani | 493/421 X |
| 4,701,233 | 10/1987 | Beck et al. | 156/227 X |

FOREIGN PATENT DOCUMENTS

| | | | |
|---|---|---|---|
| 60-15355 | 1/1985 | Japan | 493/421 |

*Primary Examiner*—Michael W. Ball
*Assistant Examiner*—Jeff H. Aftergut
*Attorney, Agent, or Firm*—Lawrence E. Sklar; David E. Pitchenik; Melvin J. Scolnick

[57] ABSTRACT

Apparatus for applying moisture to a flexible document containing a water-activated adhesive. The apparatus includes a reservoir for storing a source of water, a mounting bracket extending from the reservoir, a pivotable hammer pivotably mounted to the bracket and extending toward the reservoir, and a moistening wick extending from the reservoir toward the pivotable hammer. The area between the moistening wick and the pivotable hammer defines a document path. The apparatus further comprises a flexible, one-way gate secured to the lower portion of the hammer for movement therewith, the gate having an end portion extending into the document path. The apparatus also includes a gate deflector secured to the gate and lower hammer portion for movement therewith. Movement of a document up the document path from the gate deflector toward the pivotable hammer causes the gate to flex out of the document path and movement of a document down the document path from the pivotable hammer toward the gate deflector causes the gate to engage the document and bend around the gate deflector to thereby cause the hammer to pivot and urge the document against the wick. Thus, moisture is applied to those portions of the document urged against the wick. The invention is especially useful in combination with a buckle chute folder.

7 Claims, 5 Drawing Sheets

DOCUMENT MOISTENING DEVICE

BACKGROUND OF THE INVENTION

The instant invention relates to document sheets containing a water-activated adhesive that are folded and sealed in a manner that they become converted into sealed document/envelopes which can be mailed by themselves without being inserted into another envelope and which when opened constitute a self-contained document. More particularly, the instant invention relates to apparatus for folding and sealing such document sheets.

Millions of business correspondence forms are utilized in commerce and the like, such as billing invoices, delivery notification, and the like. At the present time, multi-sheet business forms, some utilizing carbon paper or other means of duplication, are sold by manufacturers and delivered to the users. The forms are removed from their shipping container and inserted in a typewriter or printer which may be operated by a computer. The billing information or the like may be fed into a computer system which operates the typewriter or printer, to place the desired billing information on the forms. Each form may differ in its information, in that the typewriter or printer will insert a different customer with a different address, and a different billing amount (or other information) for each form.

In the above prior art systems, it is necessary for the forms to carry severable, lateral side strips having holes into which the pins of a form feeding sprocket fit, so that there is precise control of the position of the data entered onto the various layers of the business form, which is typically pre-printed. The pre-printed portions must of course be in precise registration with the material which is added by the computerized typewriter or printer.

After the desired information has been entered by the computerized typewriter or printer, the forms are manually severed from each other, and the side strips with holes are removed. The forms may then be placed in an envelope.

The amount of paper in the side strips generally constitutes approximately 10 percent of the entire paper used in the forms, and thus constitutes a significant waste of paper, since the side strips are discarded. Furthermore, a considerable amount of manual labor is necessary to remove the forms from the typewriter or printer, to separate the forms and insert them into envelopes. Additionally, a significant amount of waste and delay is encountered by the simple step of shipping the blank business forms to the processor, involving the added expense of packaging materials and shipping expenses.

In response to the foregoing problems, a process has been developed for the production of message-containing envelopes in which the message may differ. Because the lateral, removable, perforated portions for alignment are unnecessary, there is a substantial savings in paper. The end product of this process constitutes a sealed, addressed envelope, ready for mailing. Many of the processes utilized to form such envelopes are complex and require novel components and methods, which in many cases have proven commercially unreliable. The instant invention relates to apparatus for forming such envelopes from flexible sheets containing a water-activated adhesive but has the advantage that the apparatus is an addition to conventional buckle chute folding apparatus, and thus is easily and economically implemented.

SUMMARY OF THE INVENTION

Accordingly, the instant invention provides apparatus for applying moisture to a flexible document containing a water-activated adhesive. The apparatus comprises a reservoir for storing a source of water, a supporting arm extending from the reservoir, a pivotable hammer pivotably mounted to the supporting arm and extending toward the reservoir, and a moistening wick extending from the reservoir toward the pivotable hammer. The area between the moistening wick and the pivotable hammer defines a document path. The apparatus further comprises a flexible, one-way gate secured to the lower portion of the hammer for movement therewith, the gate having an end portion extending into the document path. The apparatus also includes a gate deflector secured to the gate and lower hammer portion for movement therewith. Movement of a document up the document path from the gate deflector toward the pivotable hammer causes the gate to flex out of the document path and movement of a document down the document path from the pivotable hammer toward the gate deflector causes the gate to engage the document and bend around the gate deflector to thereby cause the hammer to pivot and urge the document against the wick, thereby applying moisture to those portions of the document urged against the wick.

The invention is especially useful in combination with a buckle chute folder.

DESCRIPTION OF THE PREFERRED EMBODIMENT

Figure 2:
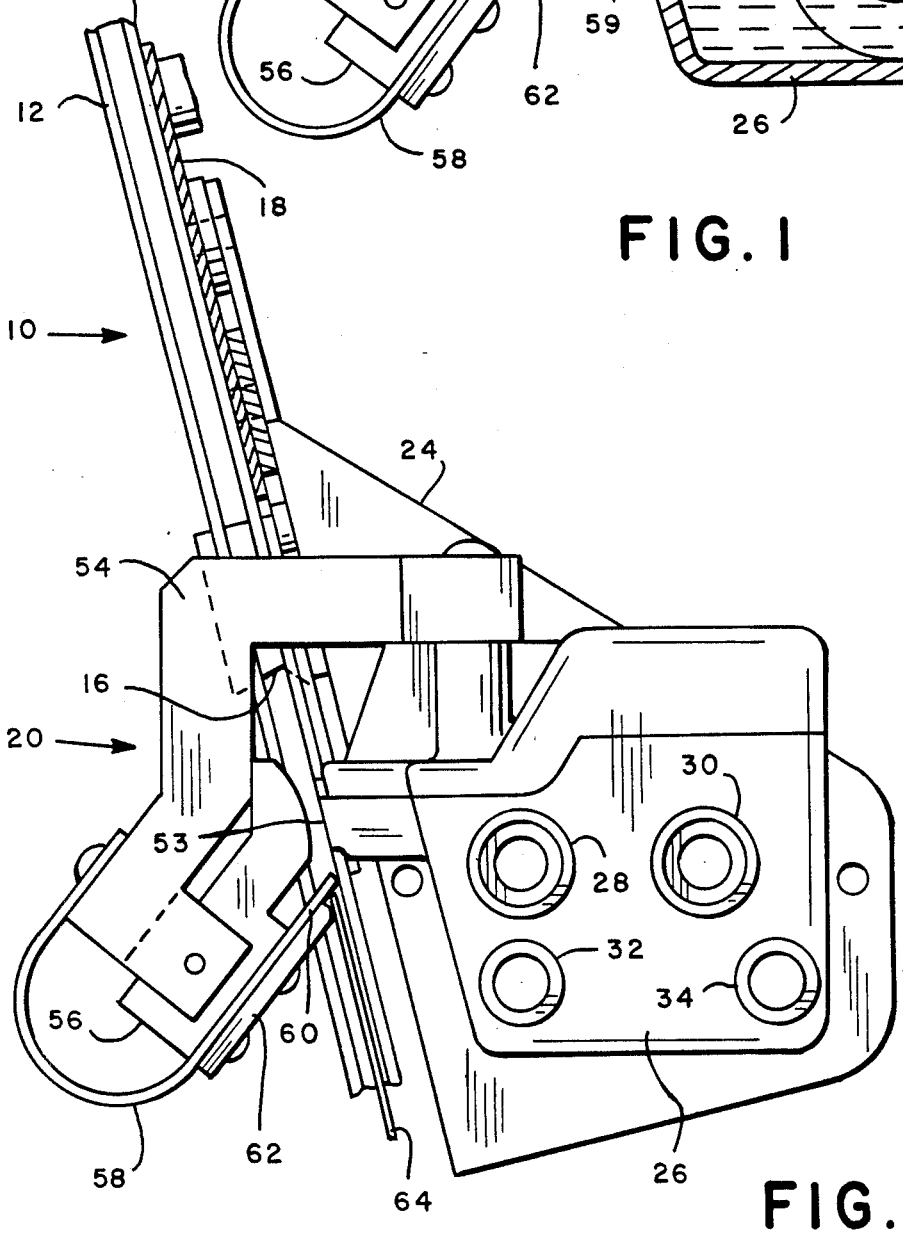
FIG. 2 is a side elevational view of a buckle chute in combination with the moisture applying device seen in FIG. 1 showing a paper document entering the buckle chute.

In describing the preferred embodiment of the instant invention, reference is made to the drawings, wherein there is seen in FIG. 2 a substantially vertically oriented buckle chute 10 consisting of a pair of opposing plates 12 and 14 with a space therebetween which defines a document path. The buckle chute 10 also includes an adjustable plate 18 slidably mounted in slots 21 and 23 in the plate 14. The adjustable plate 18 also has a stopping bar 16 secured thereto. The horizontal orientation of the stopping bar 16 can be adjusted by means of a bolt 28 which moves one side of the stopping bar 16 up or down relative to the adjustable plate 18.

Figure 1:
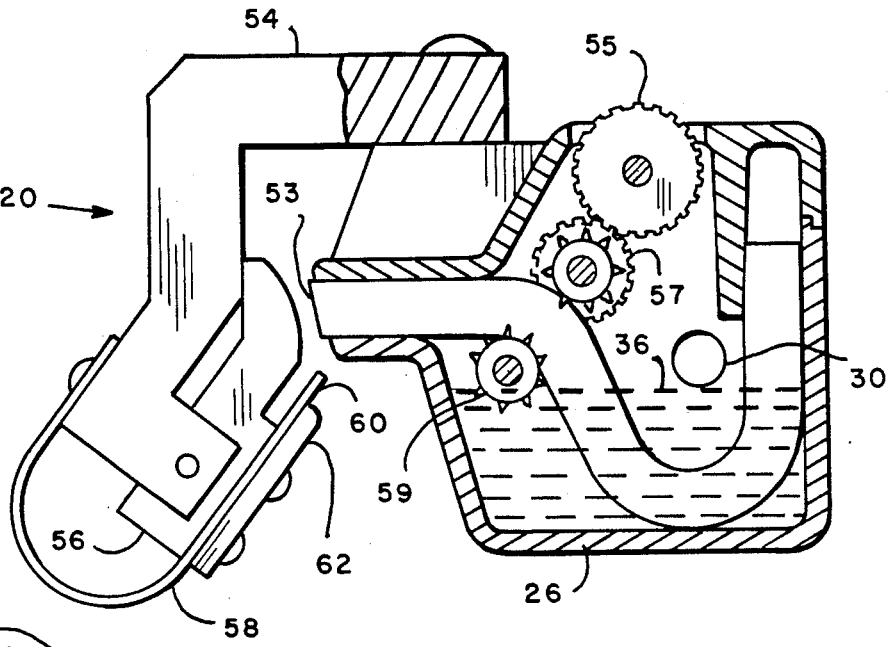
FIG. 1 is a vertical sectional view of a device for applying moisture to a flexible document containing a water-activated adhesive in accordance with the instant invention.
Figure 3:
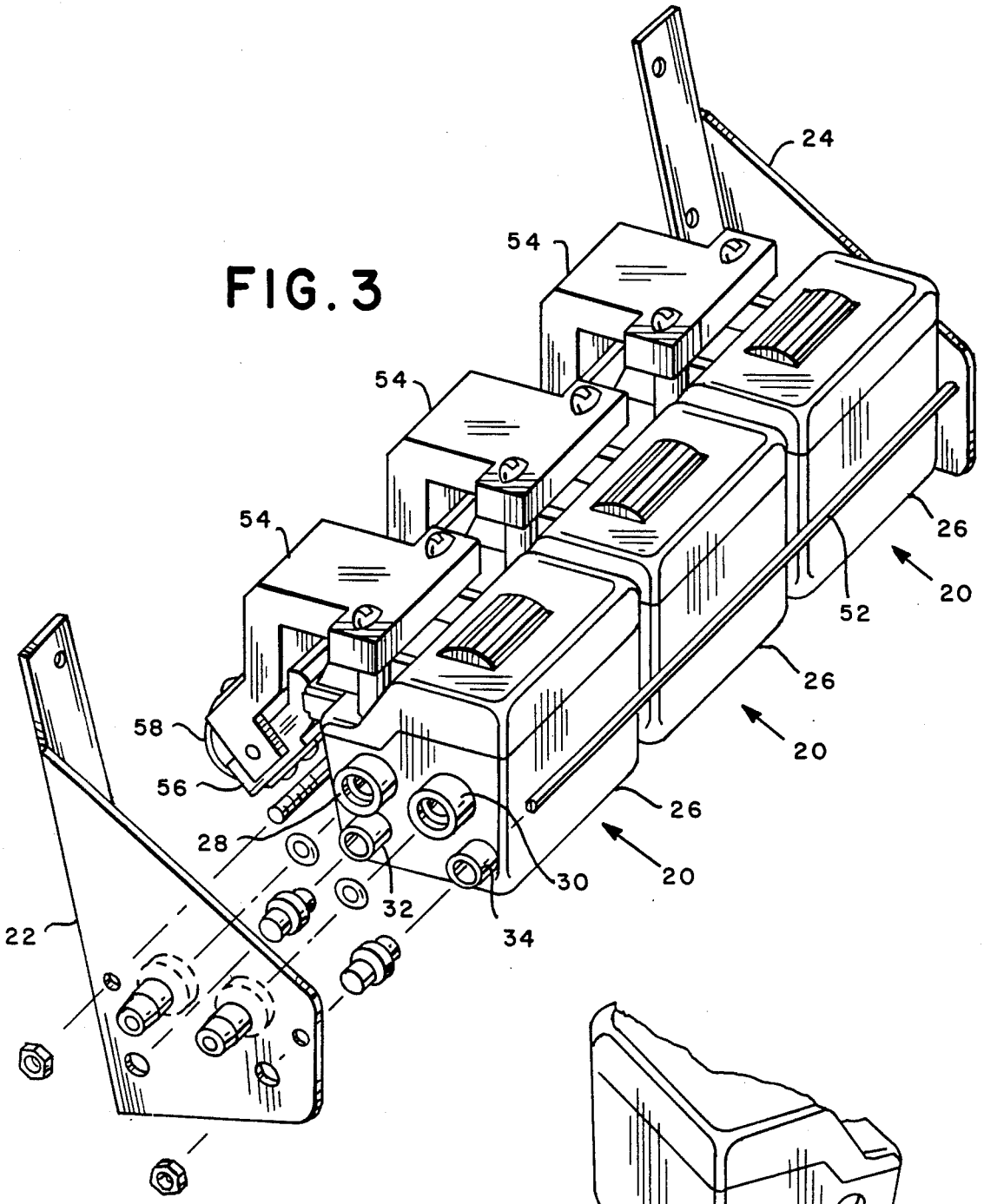
FIG. 3 is a perspective view of three moisture applying devices seen in FIG. 1 together with a pair of mounting brackets.
Figure 4:
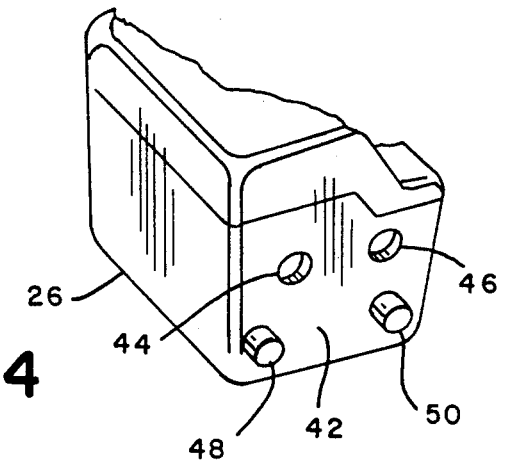
FIG. 4 is a perspective view of the two sides of the moisture applying device not visible in FIG. 3.

Also extending from the adjustable plate 18 are a pair of mounting brackets 22 and 24. Three moistening devices generally designated 20 are located between the brackets 22 and 24 and extend to both sides of the buckle chute 10. Each moistening device 20 includes a reservoir 26 having four ports 28, 30, 32 and 34 on one side thereof which can be utilized in a variety of ways. In the embodiment shown, the ports 28 and 30 are utilized as inlet/outlet ports for water 36 which is pumped into the reservoir 26 by a pump 38 from a large container of water 40. The ports 32 and 34 are utilized as locators in order to secure each of the reservoirs 26 to each other and to the brackets 22 and 24. FIG. 4 illustrates the side 42 of the reservoirs 26 not seen in FIG. 3 and shows inlet/outlet ports 44 and 46 and locator ports 48 and 50. A rod 52 extending between the brackets 22 and 24 further secures and stabilizes the reservoir 26. A moistening wick 53 extends from the reservoir 26 to the document path between the plates 12 and 14. The wick 53 can be advanced as needed by means of gears 55 and 57 and locator sprocket 59 (see FIG. 1). The gear 55 can be manually rotatated.

Each moistening device 20 includes a supporting arm 54 extending from the reservoir 26. A pivotable hammer 56 is pivotably mounted to the supporting arm 54 and extends toward the reservoir 26. A flexible, one-way gate 58 is secured to the lower portion of the hammer 56 for movement therewith. The gate 58 includes an end portion 60 which extends into the document path. A gate deflector 62 is secured to the gate 58 and hammer 56 for movement therewith.

It is to be understood that the buckle chute 10 has associated with it (but not shown) a series of rollers which feed a document 64 up the buckle chute 10 and continue to feed the document 64 after it has reached the stopping bar 16 into another series of rollers which impart the desired fold to the document 64. Such rollers are conventional and their use with buckle chutes is well known. The moistening device 20 is used to apply moisture to a flexible document 64 which contains a water-activated adhesive on some portions thereof. The adhesive portions could be anywhere on the document, and typically in the case of a flexible document to be formed into a sealed envelope, would run along the sides of the document 64 and also comprise three areas on the interior of the document 64 somewhat near the marginal edge portions. The moistening devices 20 can be used to apply moisture to the sides of the document 64 as well as to the marginal edge portions. It can be seen in FIG. 3 that the embodiment shown therein is intended to apply moisture to three areas of the document 64 since three moistening devices 20 are employed. It is possible to use one moistener 20 to wet just one area, or as many as desired for the particular document 64 being folded and sealed into an envelope. It should be understood that the moisture can be applied either to the areas containing the water-activated adhesive or the areas of the document 64 lacking such adhesive but which later are brought into contact with such adhesive-containing areas.

Figure 5:
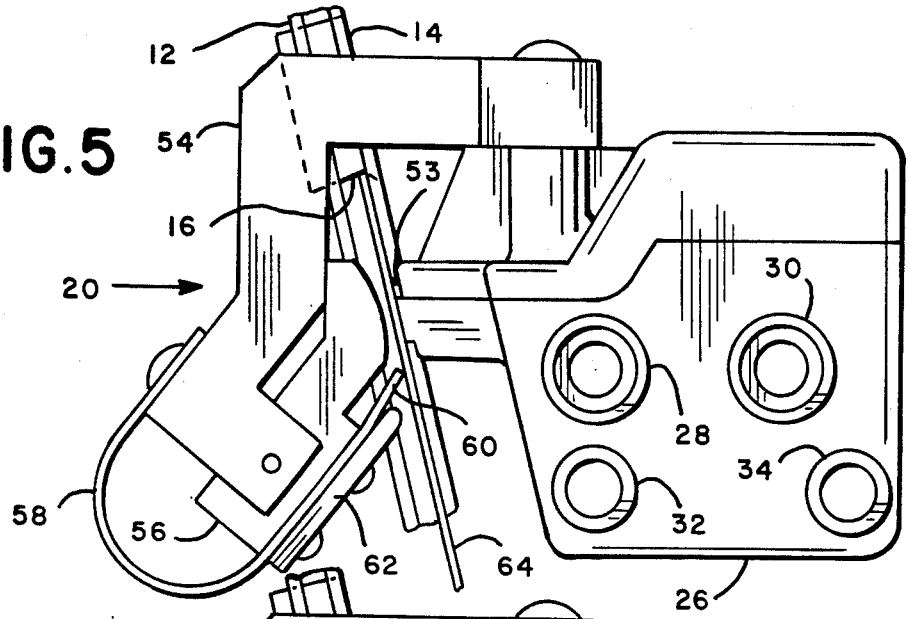
FIG. 5 is a side elevational view of the apparatus seen in FIG. 2 except that the paper document has reached the stopping bar of the buckle chute.
Figure 6:
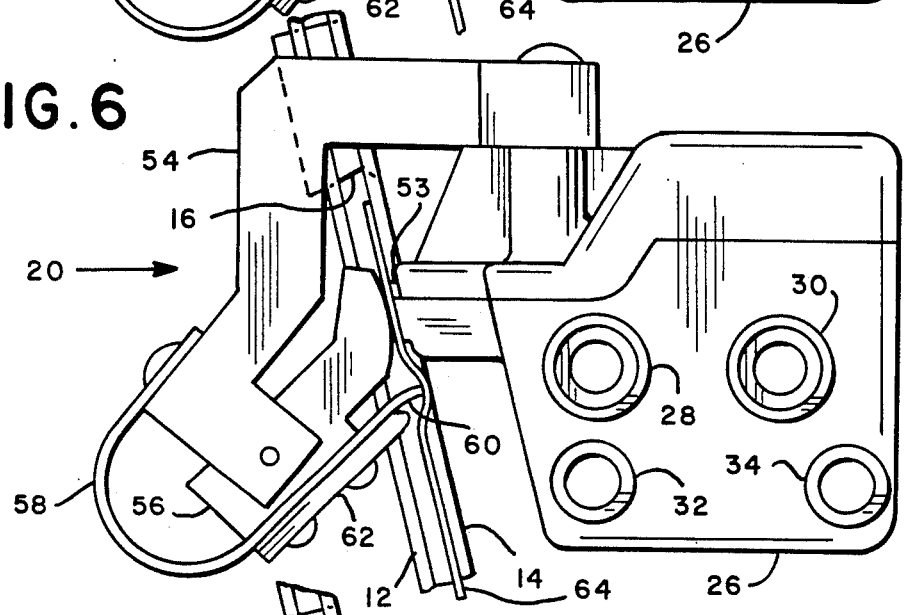
FIG. 6 is the same as FIG. 5 except that the paper document is starting its exit from the buckle chute.
Figure 7:
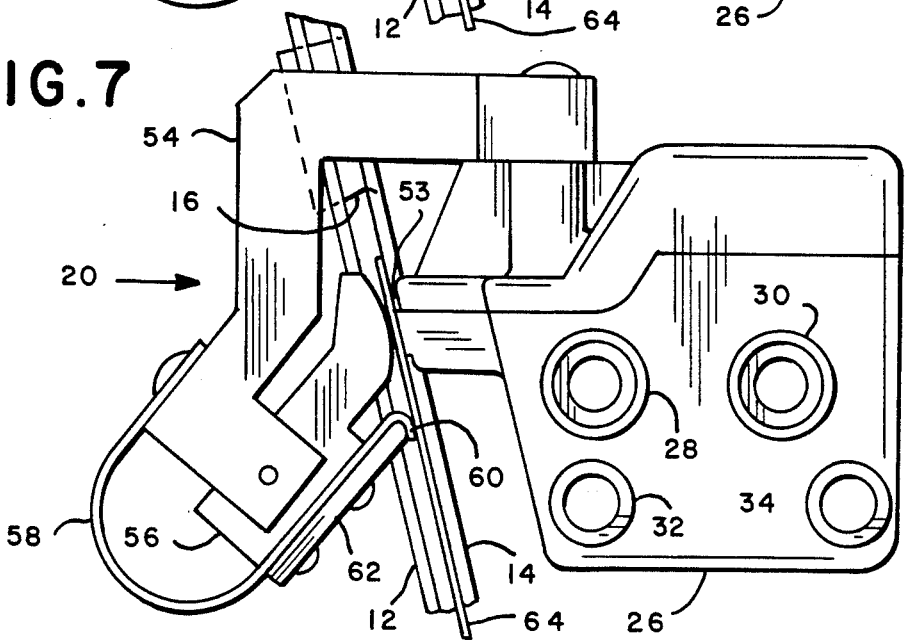
FIG. 7 is the same as FIG. 6 except that the paper document has traveled further down the buckle chute and the document is firmly urged against the wick.
Figure 8:
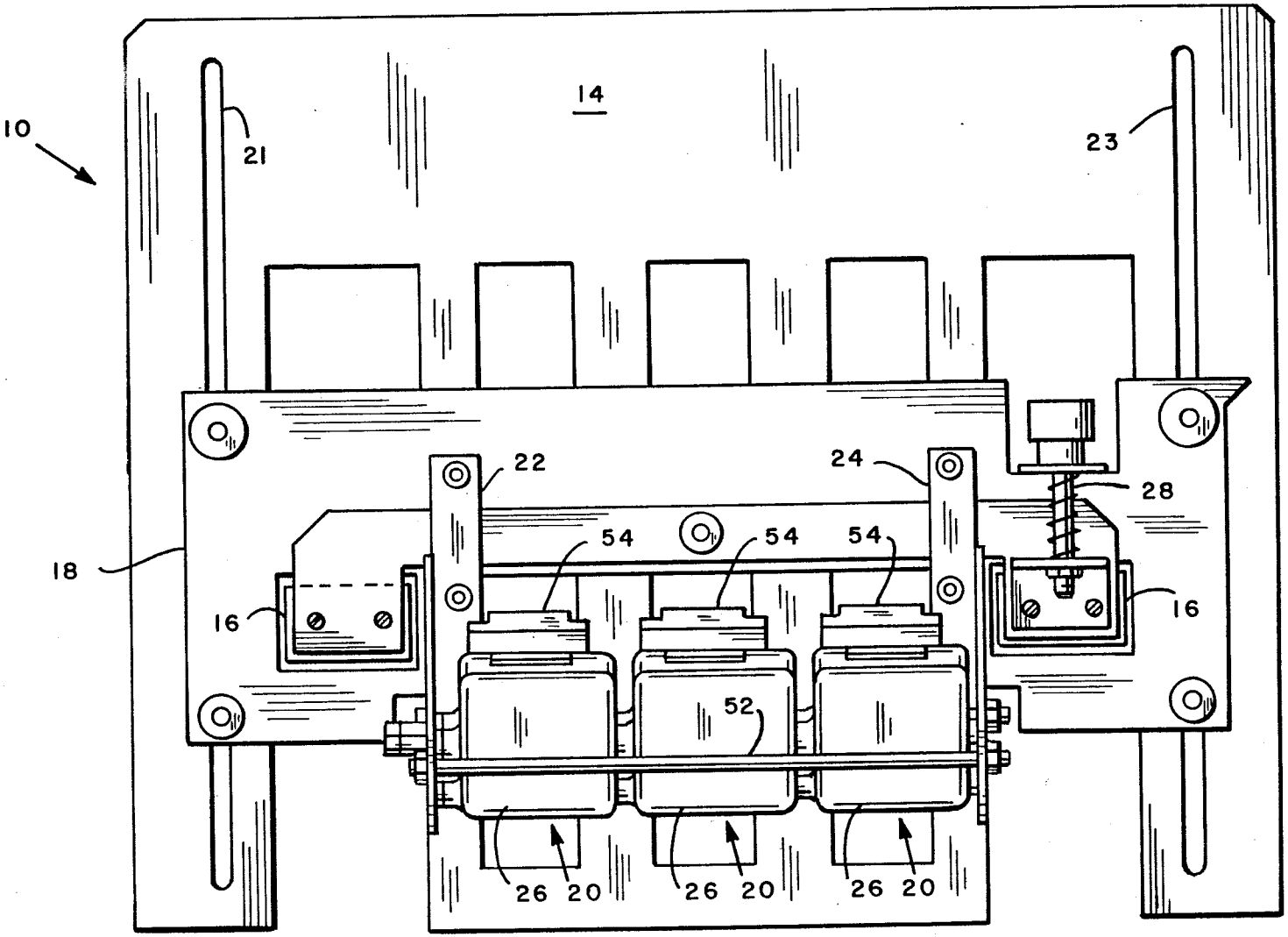
FIG. 8 is a front elevational view of the buckle chute and moisture applying device seen in FIG. 2.
Figure 9:
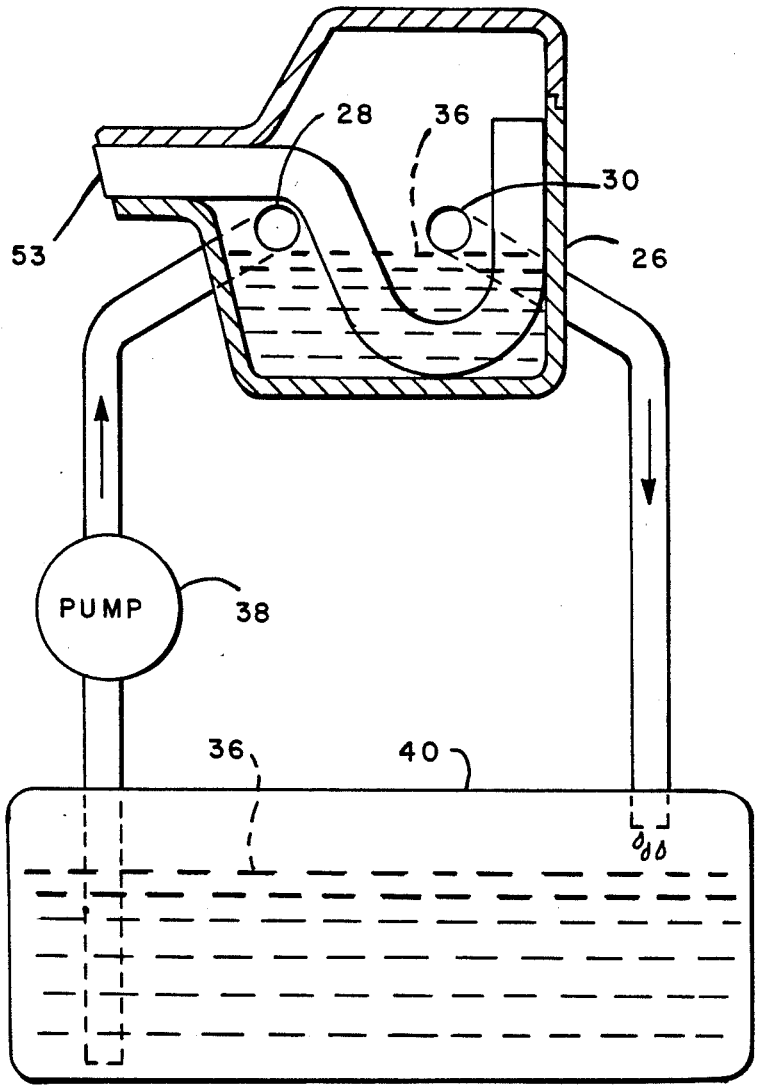
FIG. 9 is a side elevational view of the reservoir system used for the moisture applying device of the instant invention.

FIG. 2 shows the position of the hammer 56, gate 58 and deflector 62 when the document 64 enters the buckle chute 10. As the document is advanced up the buckle chute 10 by the appropriate feed rollers (not shown) the end 60 of the one-way gate 58 is deflected upward by the document 64 as seen in FIG. 5. When the document 64 reaches the stopping bar 16, a buckle is created in an interior portion of the document 64 (not shown) as is well known and the document 64 continues to be fed resulting in the document 64 returning down the buckle chute 10 as seen in FIG. 6. When the document 64 is being fed down the buckle chute 10, the gate 60 is engaged by the document 64 and bends around the gate deflector 62, which causes the hammer 56 to be pivoted clockwise as seen in FIG. 7 and urges the document 64 firmly against the wick 53. Continued withdrawal of the document 64 from the buckle chute 10 wraps the gate 58 around the deflector 62 thereby developing even greater friction which in turn creates maximum force from the hammer 56 against the wick 53 and optimum water transfer from the wick 53 to the document 64.

It should be understood by those skilled in the art that various modifications may be made in the present invention without departing from the spirit and scope thereof, as descirbed in the specification and defined in the appended claims.

What is claimed is:

1. A device for applying moisture to a flexible document containing a water-activated adhesive, comprising:

a reservoir for storing a source of water;

a supporting arm extending from said reservoir;

a pivotable hammer pivotably mounted to said supporting arm and extending toward said reservoir;

a moistening wick extending from said reservoir toward said pivotable hammer but spaced therefrom, the area between said moistening wick and said pivotable hammer defining a document path;

a flexible, one-way gate secured to a portion of said hammer for movement therewith, said gate having an end portion extending into said document path; and a gate deflector secured to said gate and said hammer portion for movement therewith, wherein movement of a document along the document path from the gate deflector toward the pivotable hammer causes said gate to flex out of the document path and movement of a document along said document path from the pivotable hammer toward said gate deflector causes said gate to engage said document and bend around said gate deflector to thereby cause said hammer to pivot and urge said document against said wick, whereby moisture is applied to portions of said document urged against said wick.

2. The device of claim 1 wherein moisture is applied to an adhesive-containing portion of said document.

3. The device of claim 1 wherein moisture is applied only to areas of said document not containing said adhesive.

4. Apparatus for applying moisture to a flexible document containing water-activated adhesive, comprising:

A. a buckle chute having i. a pair of opposing plates defining a document path therebetween, said plates having one open end thereof, ii. an adjustable plate slidably mounted to one of said opposing plates, and iii. mounting means secured to said adjustable plate, and B. a moistening device fixedly secured to said mounting means, said moistening device including i. a reservoir for storing a source of water secured to said mounting means and situated adjacent one of said buckle chute plates on one side of said document path, ii. a supporting arm extending from said reservoir, iii. a moistening wick extending from said reservoir to said document path, iv. a pivotable hammer pivotably mounted to said supporting arm on the other side of said document path and extending toward the end of the wick extending to said document path, v. a flexible, one-way gate secured to a portion of said hammer for movement therewith, said gate having an end portion extending into said document path, and vi. a gate deflector secured to said gate and said hammer portion for movement therewith, wherein movement of a document along the buckle chute away from the open end causes said gate to flex out of the document path and movement of a document along said buckle chute toward said open end causes said gate to engage said document and bend around said gate deflector to thereby cause said hammer to pivot and urge said document against said wick, whereby moisture is applied to portions of said document urged against said wick.

5. The apparatus of claim 4, wherein moisture is applied to an adhesive-containing portion of said document.

6. The apparatus of claim 4, wherein moisture is applied only to areas of said document not containing said adhesive.

7. The apparatus of claim 4 comprising a plurality of moistening devices.

* * * * *